US008245686B2

(12) United States Patent
Xia

(10) Patent No.: US 8,245,686 B2
(45) Date of Patent: Aug. 21, 2012

(54) NON-CRANKSHAFT ENGINE

(76) Inventor: Huarong Xia, Tianjin (CN)

( * ) Notice: Subject to any disclaimer, the term of this patent is extended or adjusted under 35 U.S.C. 154(b) by 923 days.

(21) Appl. No.: 12/227,390

(22) PCT Filed: Sep. 21, 2006

(86) PCT No.: PCT/CN2006/002469

§ 371 (c)(1),
(2), (4) Date: Nov. 13, 2008

(87) PCT Pub. No.: WO2007/033593

PCT Pub. Date: Mar. 29, 2007

(65) Prior Publication Data

US 2011/0146615 A1 Jun. 23, 2011

(30) Foreign Application Priority Data

Sep. 22, 2005 (CN) ..... 2005 1 0015166

(51) Int. Cl.
*F02B 75/32* (2006.01)

(52) U.S. Cl. ..... 123/197.1; 123/197.5

(58) Field of Classification Search ..... 123/197.1, 123/197.5

See application file for complete search history.

(56) References Cited

U.S. PATENT DOCUMENTS

| | | | | |
|---|---|---|---|---|
| 1,402,866 | A * | 1/1922 | Joy | 123/53.3 |
| 1,419,159 | A * | 6/1922 | McKechnie | 92/69 R |
| 1,447,127 | A * | 2/1923 | Enderby | 123/51 BB |
| 4,215,660 | A * | 8/1980 | Finley | 123/78 E |
| 5,562,075 | A * | 10/1996 | Walsh | 123/197.1 |

FOREIGN PATENT DOCUMENTS

JP 60036731 A * 2/1985

* cited by examiner

*Primary Examiner* — Noah Kamen
(74) *Attorney, Agent, or Firm* — Leong C. Lei

(57) ABSTRACT

This invention discloses a non-crankshaft engine which includes the body, the cylinder head on top of the body, and the cylinder inside it. A piston intersecting with one end of a connecting rod is set in the cylinder. In the middle of the chassis where the engine body is set on, there is the basic shaft which intersects with one or more crossbars perpendicularly in way of either fixed joint or swing joint. On the crossbar is installed symmetrically on either side of the axis of the basic shaft a fixing set. It connects with the other end of the connecting rod through a swing joint. Every fixing set is joined by one or two connecting rods linked with the piston. The above structure of basic shaft, crossbar and connecting rod will result in strong explosion pressure that can produce great moment of force, and thus give the utmost work. Therefore, this invention has the advantages of high working efficiency, low energy-consumption, and is expected to produce minimum environmental pollution.

8 Claims, 12 Drawing Sheets

NON-CRANKSHAFT ENGINE

BACKGROUND OF THE INVENTION (a) Technical Field of the Invention

The present invention relates to an internal combustion engine, and in particular to a non-crankshaft engine, which has the advantages of high working efficiency, low energy consumption, and producing minimum environmental pollution.

(b) Description of the Prior Art

The moving components of a conventional engine (for example, an internal combustion engine, such as a diesel engine, a petrol engine, and a gas engine fueled by natural gas, including two-stroke and four-stroke engines) are fundamentally made up of a crankshaft (10) (including a shaft journal (11) and a crank (12)), a connecting rod (2), and a piston (1), as shown in FIGS. 14 and 15. In operation, an explosion stroke starts with the piston (1) being at or close to an upper stop point. A huge expansion pressure generated by combusting fuel has little or no effect on the rotation of the crankshaft. Due to a very small or virtually no distance between a center line of the crankshaft (10) and the application point of force transmitting through the piston (1), the connecting rod (2), and the crank (12) to the crankshaft (10), a very small or virtually no moment is produced. As a result, the crankshaft (10) does not run properly, and this leads to a very small or virtually no power induced by the rotation of the crankshaft. Therefore, the most serious defects of the conventional internal combustion engine are low efficiency, high energy consumption, and serious environmental pollution.

SUMMARY OF THE INVENTION

The primary purpose of the present invention is to provide a non-crankshaft engine with high working efficiency, low energy consumption, and environmental-friendliness.

The technical scheme adopted in the invention is: a non-crankshaft engine which includes a body, a cylinder head mounted on a top of the body, and a cylinder formed inside the body. A piston connected with one end of a connecting rod is set in the cylinder. In the middle of a chassis where the body is set, a basic shaft is arranged to perpendicularly intersect a crossbar by means of a fixed joint or a swing joint. The crossbar is installed, symmetrically on either side of an axis of the basic shaft, with a fixing set. The fixing set connects with the other end of the connecting rod through a swing joint.

The basic shaft connects with one or more crossbars. Every fixing set on the crossbar has one or two connecting rods which connect with the piston.

When the piston is at one stop point of the cylinder head, a center line of the cylinder head intersects a perpendicular of a center line of the crossbar at an angle $\phi$, where $\phi$ is equal to or greater than 0° but smaller than 30° ($0° \leqq \phi < 30°$). Meanwhile, a center line of the connecting rod intersects the center line of the cylinder at an angle $\beta_0$, where $\beta_0$ is equal to or greater than 0° but smaller than 15° ($0° \leqq \beta_0 < 15°$).

Another technical scheme adopted in the invention is a non-crankshaft engine including a body, a cylinder head mounted on a top of the body, and a cylinder formed inside the body. A piston received in the cylinder is connected with one end of a connecting rod. In the middle of a chassis where the body is set, a basic shaft is arranged to perpendicularly intersect two or more crossbars by means of a fixed or a swing joints. Arranged on one side of the basic shaft is a crossbar that is installed with a fixing set or a power output unit, and arranged on the other side is a crossbar with the same installments, but in reverse order. The fixing set connects with the other end of the connecting rod through a swing joint.

When the piston is at one stop point of the cylinder head, a center line of the cylinder head intersects with a perpendicular of a center line of the crossbar at an angle $\phi$, where $\phi$ is equal to or greater than 0° but smaller than 30° ($0° \leqq \phi < 30°$). Meanwhile, a center line of the connecting rod intersects with the center line of the cylinder at an angle $\beta_0$, where $\beta_0$ is equal to or greater than 0° but smaller than 15° ($0° \leqq \beta_0 < 15°$).

With the non-crankshaft engine having a basic shaft, a crossbar, and a connecting rod that adopt the above described structure, it is possible to choose a suitable distance between the application point of the explosion pressure generated at the beginning of the explosion stroke and the center line of the basic shaft. The choice is made according to the needs of power of engine, the dimension of the cylinder bore and the stroke. In this way, the arm of force between the application point of the explosion pressure and the basic shaft are extended dramatically so that a large moment is exerted to produce maximum work. Therefore, the engine has the advantages of high working efficiency, low energy consumption, and minimum environmental pollution.

The foregoing object and summary provide only a brief introduction to the present invention. To frilly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIGS. 1-2 is a plan view of FIGS. 1-1;

FIGS. 1-3 is a cross-sectional view taken along line A-A of FIG. 1-2;

FIGS. 1-4 is a cross-sectional view taken along line B-B of FIGS. 1-2;

FIGS. 2-1 is a schematic view showing a non-crankshaft engine in which a crossbar and a basic shaft are connected with each other through a fixed joint;

FIGS. 2-2 is a plan view of FIG. 2-1;

FIGS. 3-1 is a schematic view showing a non-crankshaft engine in which all bodies are joined together;

FIGS. 3-2 is a plan view of FIGS. 3-1;

FIGS. 4-1 is another schematic view showing a non-crankshaft engine in actualized structure in which all bodies are joined together;

FIGS. 4-2 is a plan view of FIGS. 4-1;

In the drawings:

Figure 1:
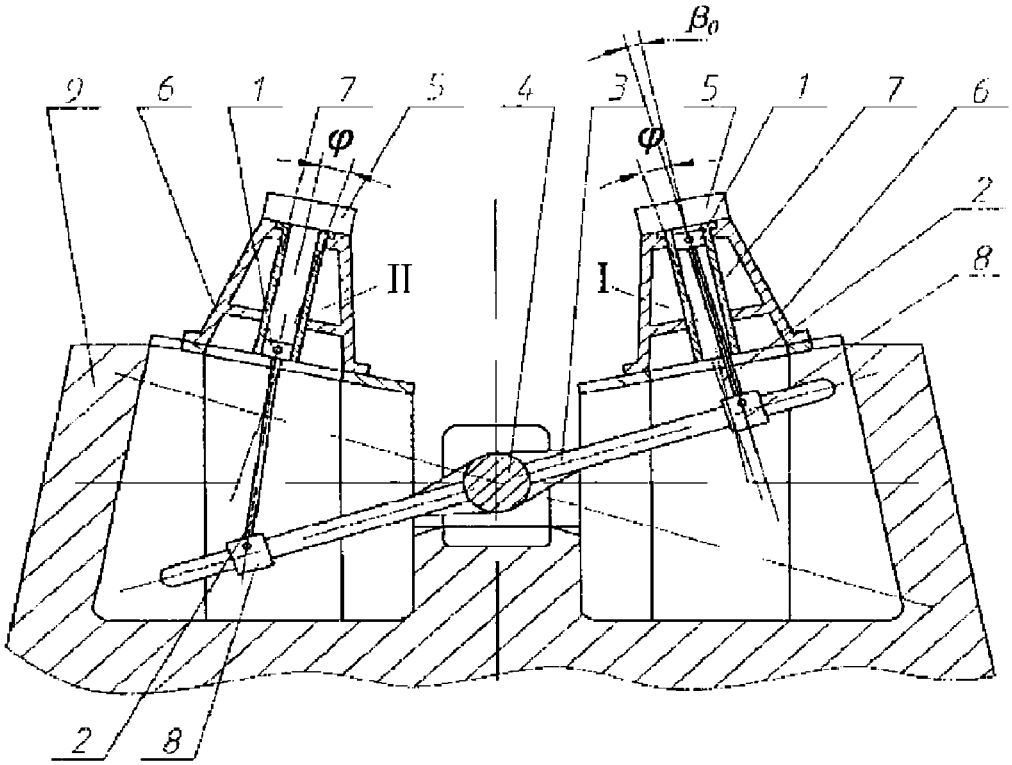
FIGS. 1-1 is a schematic view showing a fixed joint between a crossbar and a basic shaft.

1: piston 2: connecting rod 3: crossbar 4: basic shaft
5: cylinder head 6: the body 7: air cylinder 8: fixing set
9: chassis 10: crankshaft 11: shaft journal 12: crank
13: auxiliary unit 14: hydrocylinder 15: spring 16: pull rod
17: support 18: power output unit

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The operation of a non-crankshaft engine according to the present invention will be illustrated in detail with reference to the attached drawings.

As shown in FIGS. 1-1, 1-2, 1-3, and 1-4, the non-crankshaft engine includes a plurality of bodies (6), a cylinder head (5) mounted on a top of each body (6), and a cylinder (7) formed inside each body (6). A piston (1) received in each cylinder (7) is connected with one end of a connecting rod (2). In the middle of a chassis (9), where the bodies (6) are set, a basic shaft (4) is arranged to perpendicularly intersect and couple to one or more crossbars (3) by means of a fixed joint or a swing joint. The structure of the swing joint can be rolling bearing, shaft sleeve and shaft bushing, ratchet and pawl, and the likes. The fixed joint can be of a structure of welding, thread fastening, thread connection, and the likes.

The basic shaft (4) and each crossbar (3) shown in the drawing are connected by the fixed joint. The crossbar (3) is installed, symmetrically on both sides of the axis of the basic shaft (4), with a fixing set (8). The fixing set (8) connects with the other end of the connecting rod (2) through a swing joint, such as a hinge joint, a bearing, a bearing block, and the likes.

As shown in FIGS. 1-1, 1-2, 1-3, 1-4, 2-1, 3-1, 4-1, 5, and 6, each fixing set (8) of the crossbar (3) holds one or two connecting rods (2) each of which is connected to the corresponding piston (1). For an arrangement that just one connecting rod (2) is coupled to each fixing set (8), all the connecting rods (2) are set on the same side of the crossbar (3) (see FIGS. 1-1, 1-2, 1-3, and 1-4), while for an alternative arrangement that two connecting rods (2) are coupled to the crossbar (3), the two connecting rods (2) are symmetrically set on the opposite sides of the crossbar (3) (see FIGS. 2-1, 3-1, 5, and 6).

FIGS. 1-4 shows that a center line of one crossbar (3) on the basic shaft and the center lines of some other crossbars (3) on the same basic shaft may be on the same plane on the condition that the crossbars (3) rotate synchronously at the same angle.

Figures 1, 2:
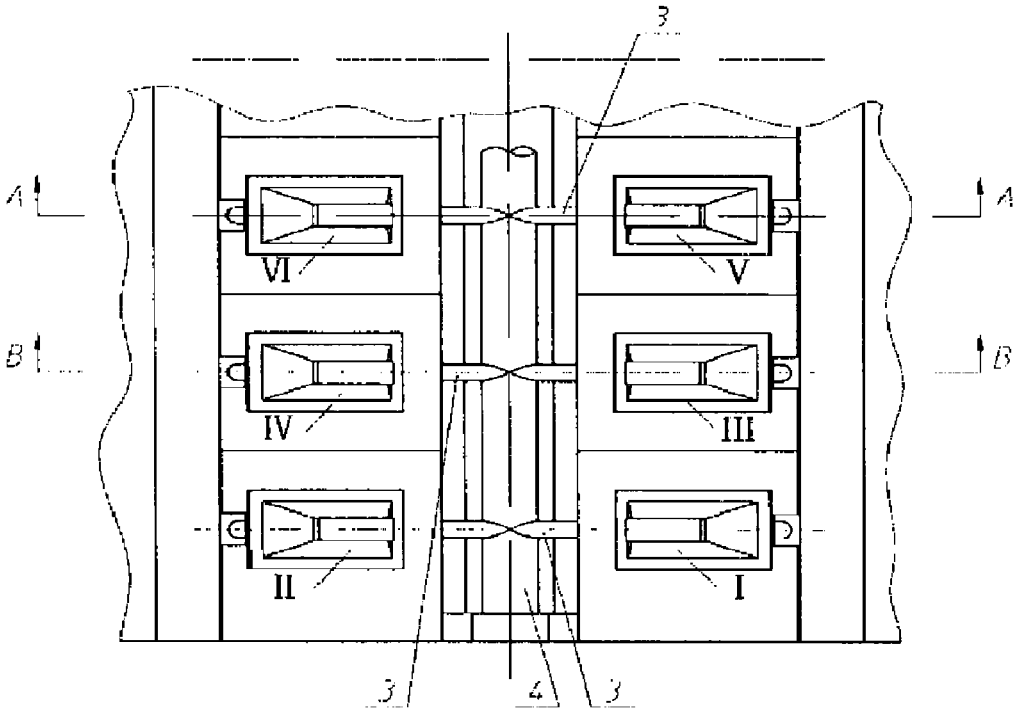
Figures 1, 2, 3:
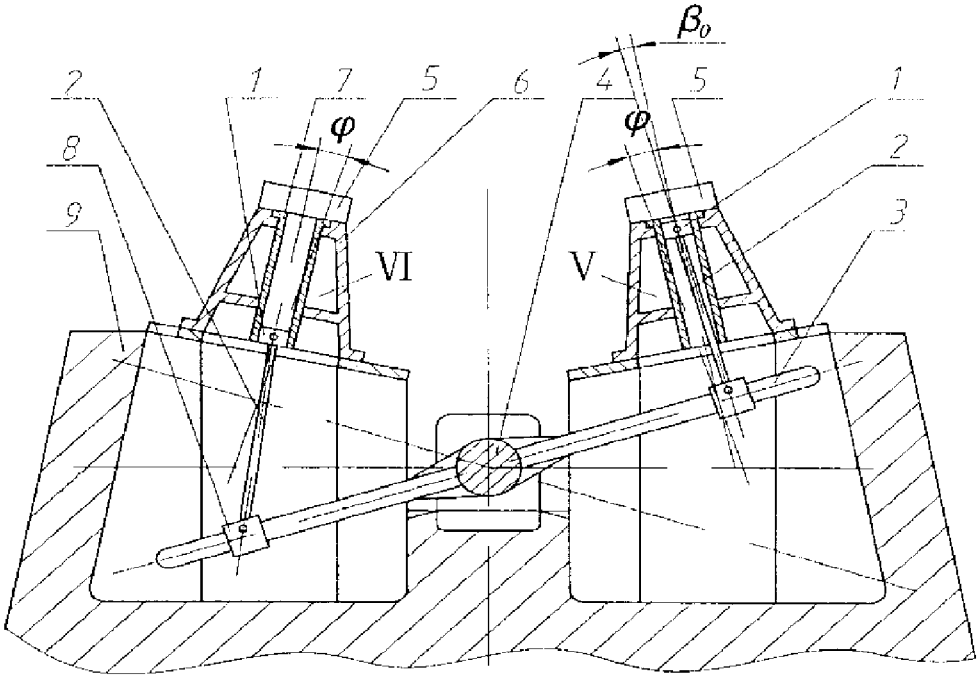
Figures 1, 2, 3, 4:
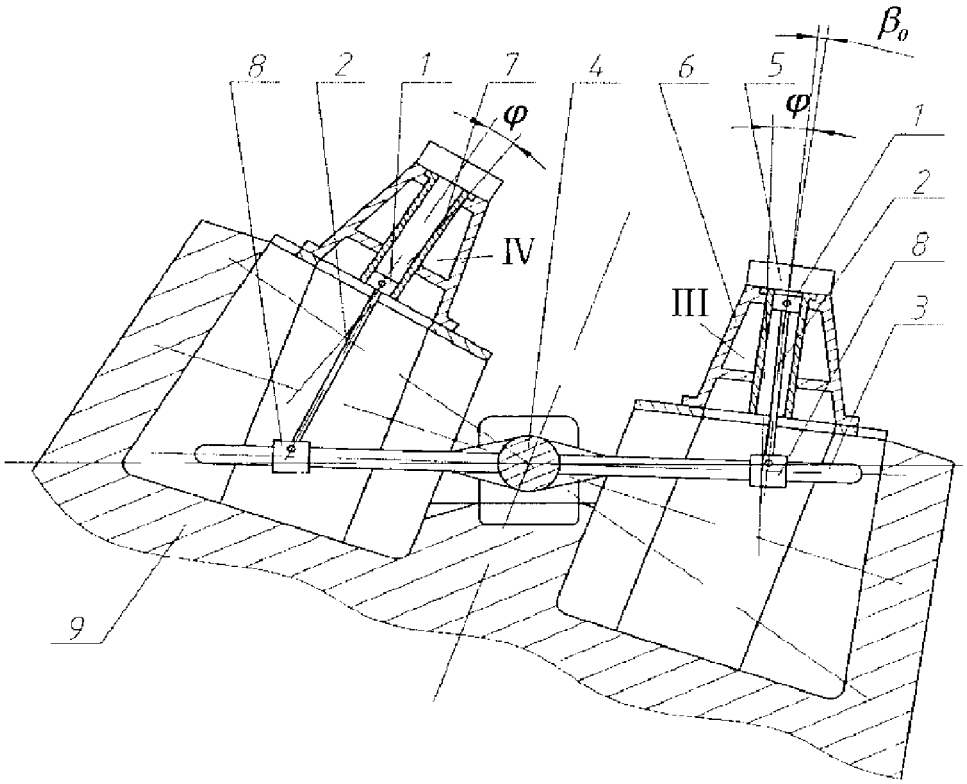
Figures 1, 2:
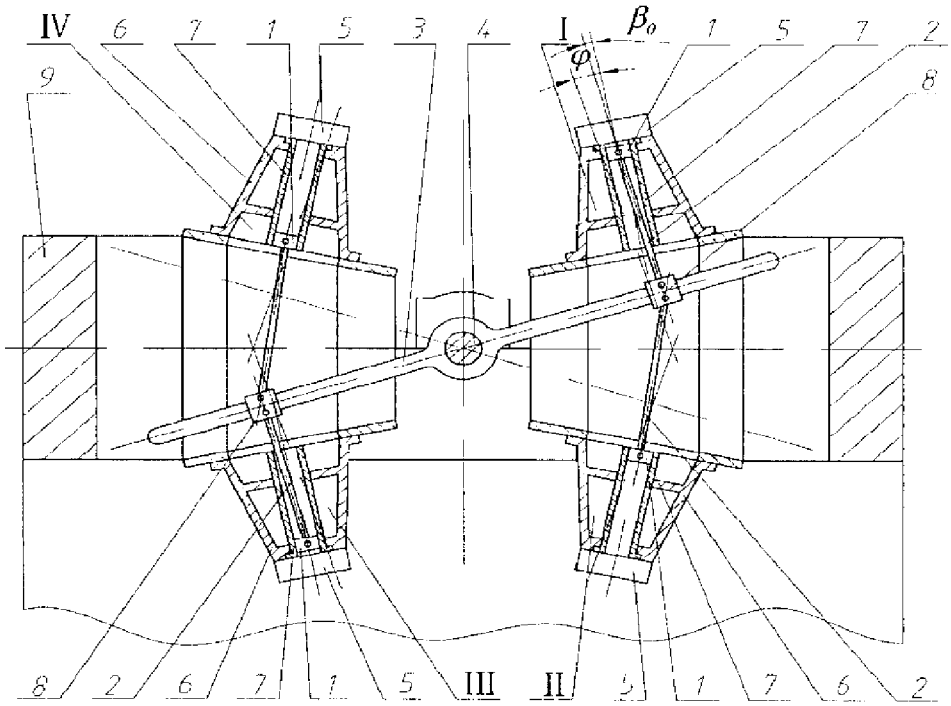
Figure 2:
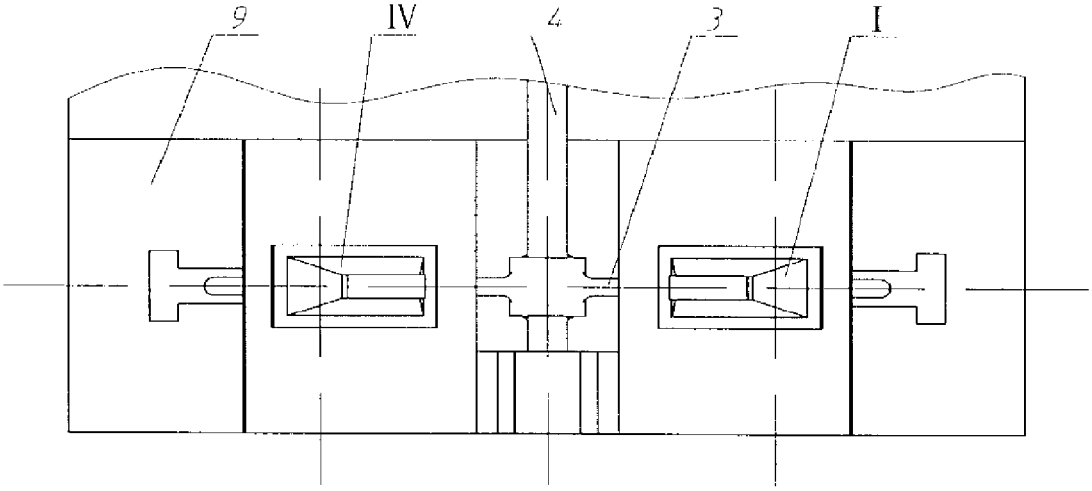
Figures 1, 3:
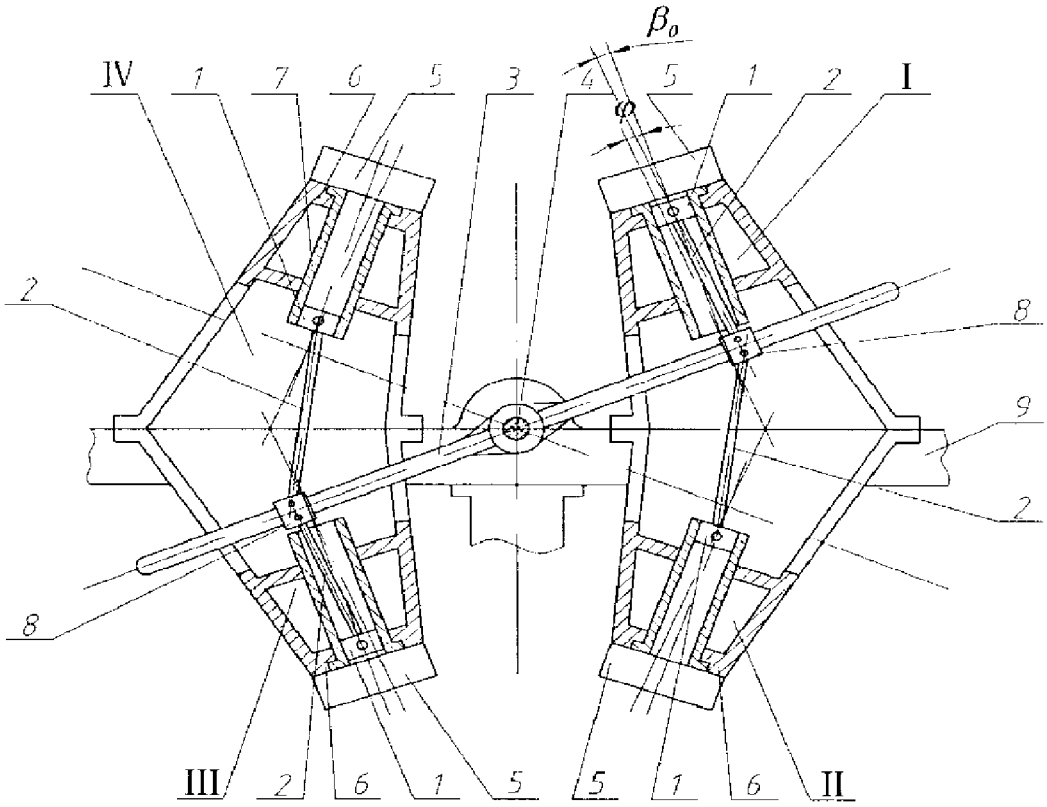
Figures 2, 3:
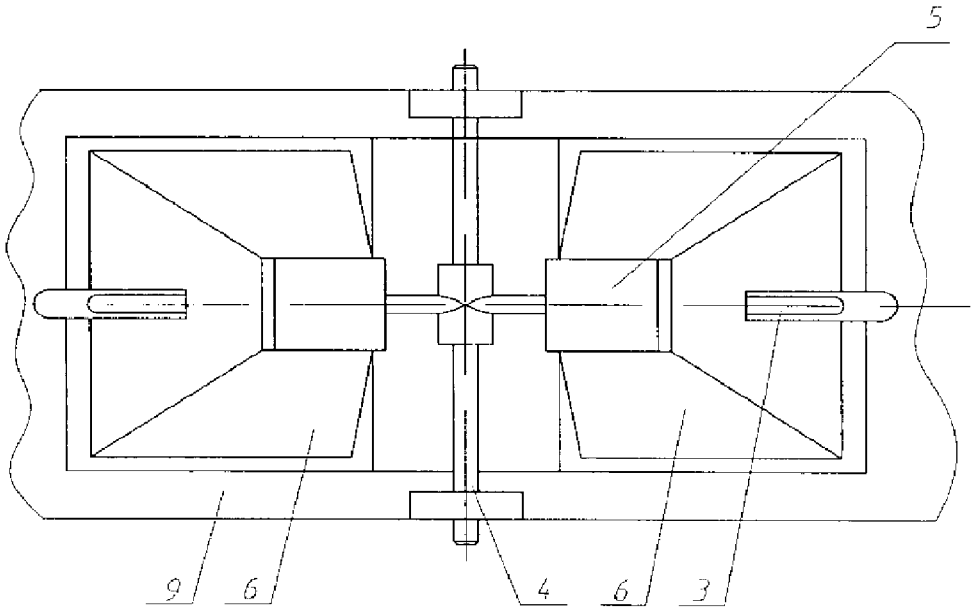
Figures 1, 4:
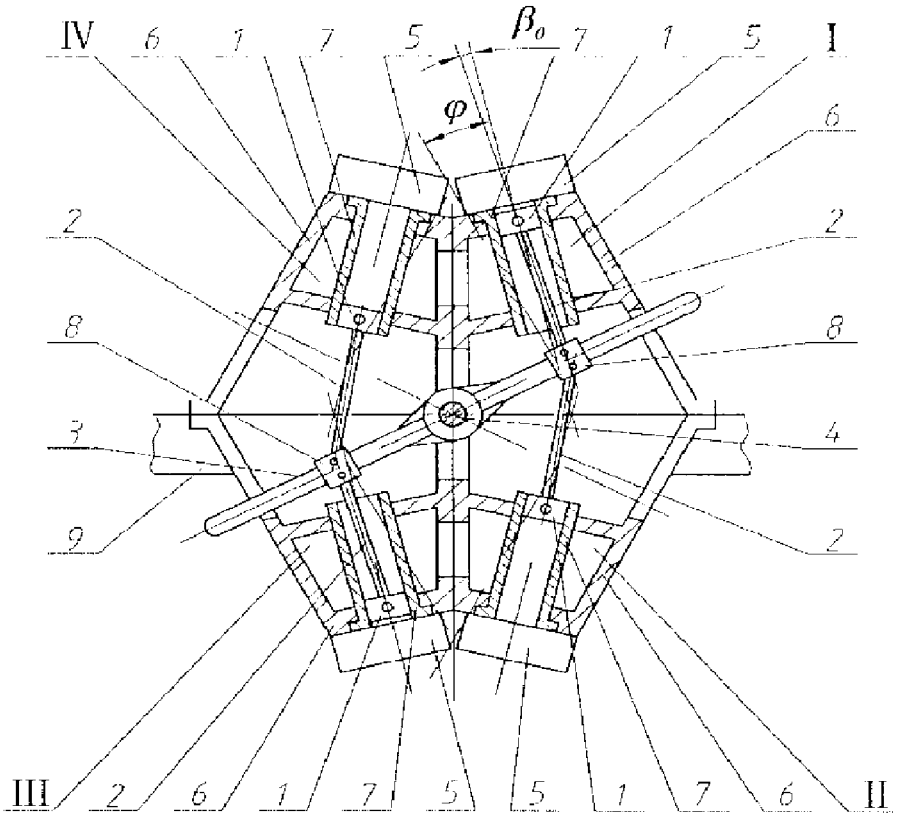
Figures 2, 4:
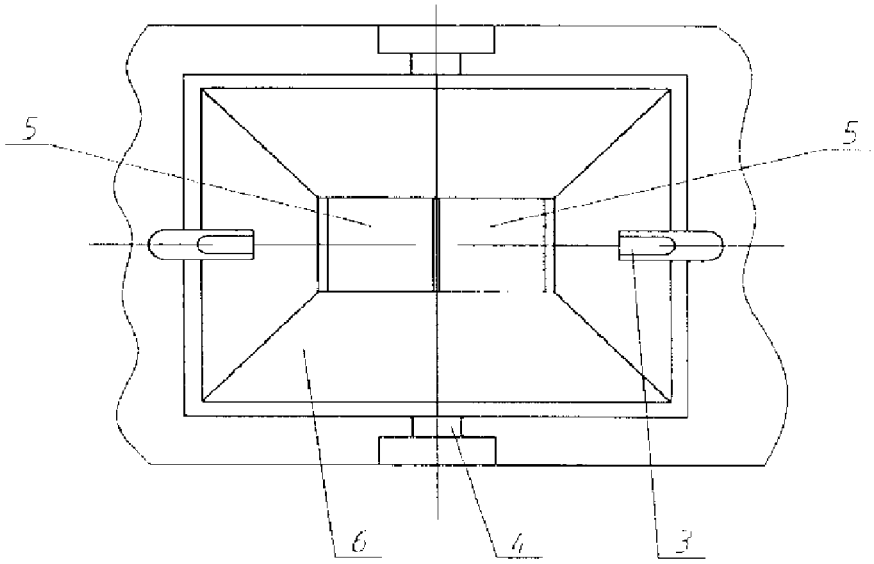
Figure 5:
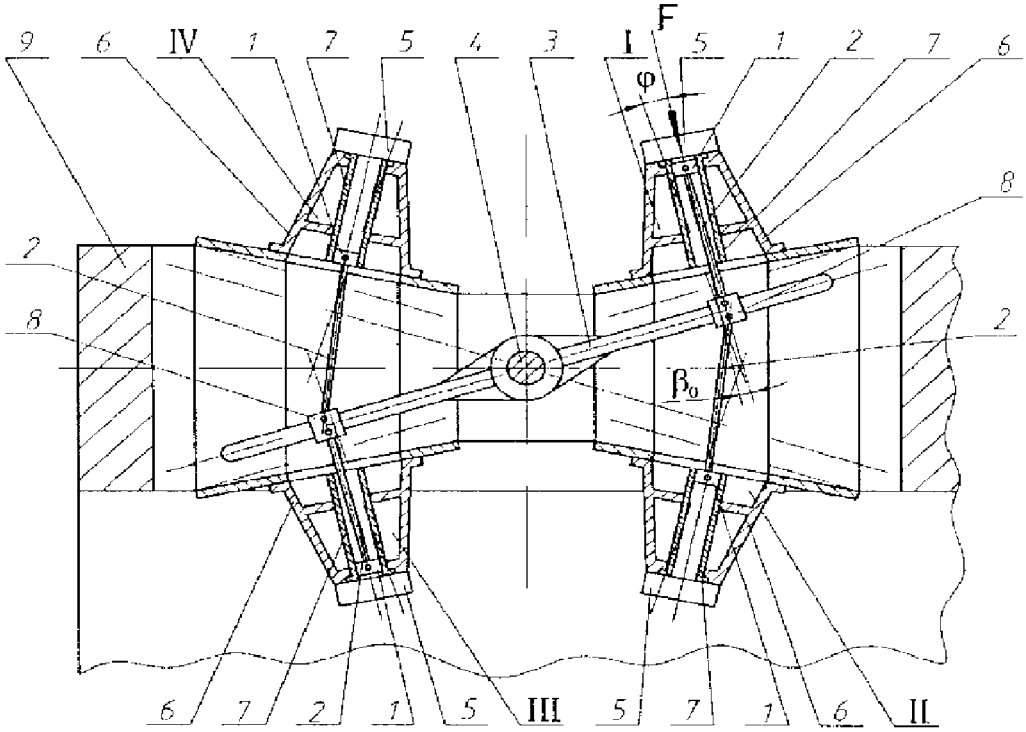
FIG. 5 is a schematic view showing a non-crankshaft engine in which a piston, a connecting rod, a crossbar, and a basic shaft are under stress at the beginning of an explosion stroke.
Figure 6:
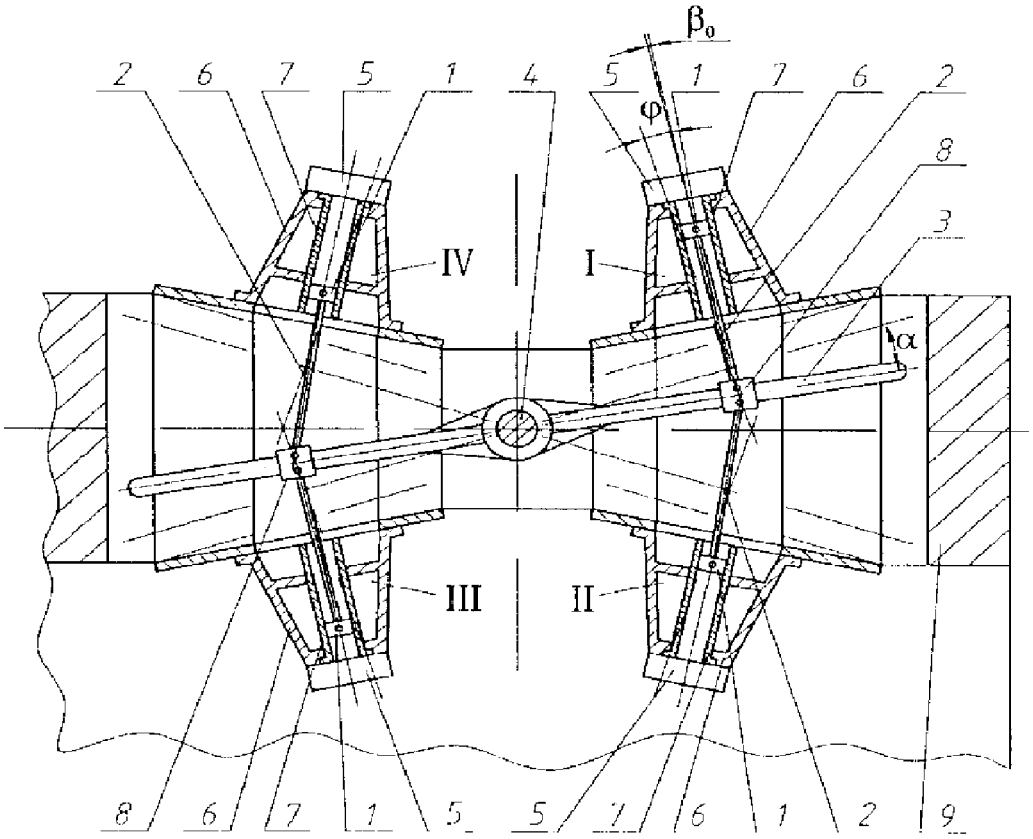
FIG. 6 is a schematic view showing the non-crankshaft engine in operation when a piston, a connecting rod, and a basic shaft are under pressure and the basic shaft rotates by an angle $\alpha$.

In FIGS. 2-1, a fixed joint is formed between the basic shaft (4) and crossbar (3); while in FIGS. 3-1, 4-1, 5, and 6, a swing joint is used.

As shown in FIGS. 7, 8, 9, and 10, a non-crankshaft engine comprises a plurality of bodies (6), a cylinder head (5) mounted on a top of each body (6), and a cylinder (7) formed inside each body (6). A piston (1) that is received in each cylinder (7) is connected with one end of a connecting rod (2). In the middle of a chassis (9) where the body (6) is set, a basic shaft (4) is arranged to perpendicularly intersect and couple to one or more crossbars (3) by means of a fixed joint or a swing joint. The swing joint can be of a structure of rolling bearing, shaft sleeve and shaft bushing, ratchet and pawl, and the likes; and the fixed joint can be of a structure of welding, thread fastening, thread connection, and the likes. On one side of the basic shaft is a crossbar (3) to which a fixing set (8) or an auxiliary unit (13) that enables the connecting rod of the piston to run continuously and normally is mounted, and on the other side of the basic shaft is a crossbar (3) to which the same installments (but in reverse order) are provided. The fixing set (8) is connected with the other end of the connecting rod (2) through a swing joint.

There is one or more crossbars (3) connected to the basic shaft (4). Moreover, each fixing set (8) mounted on the crossbar (3) holds one or two connecting rods (2) each connected to a piston (1). For an arrangement that just one connecting rod (2) is coupled to each fixing set (8), all the connecting rods (2) are set on the same side of the crossbar (3), while for an alternative arrangement that two connecting rods (2) are coupled to the crossbar (3), the two connecting rods (2) are symmetrically set on opposite sides of the crossbar (3).

Figure 7:
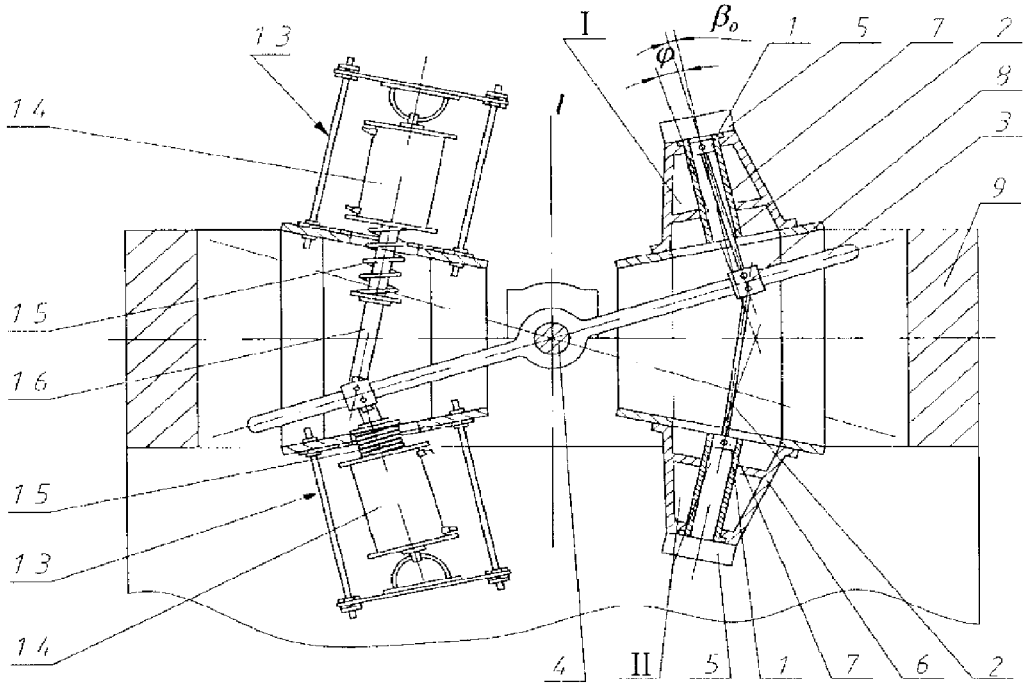
FIGS. 7 and 9 are schematic views of a non-crankshaft engine that is installed with an auxiliary unit.
Figure 8:
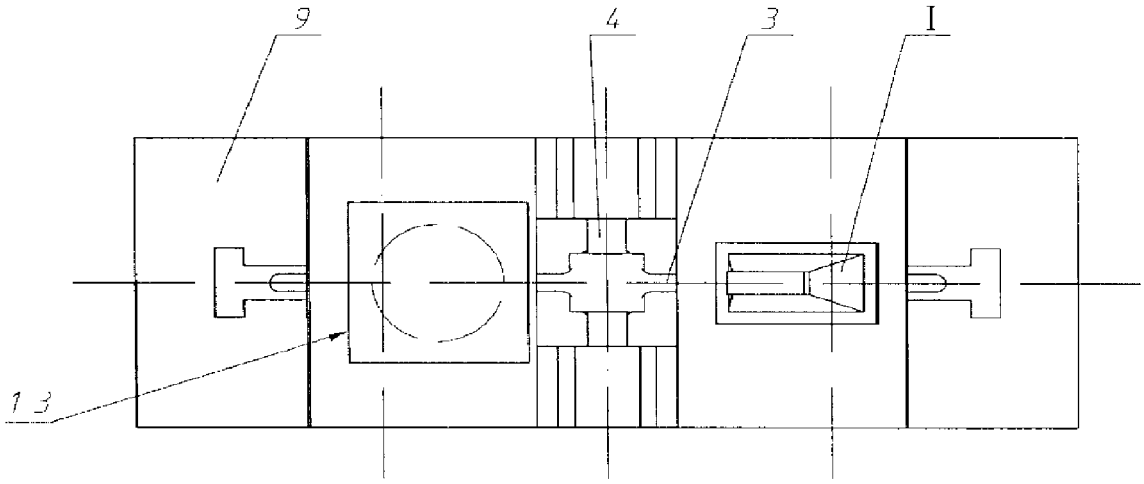
FIG. 8 is a plan view of FIG. 7.

FIG. 7 shows that when there are two connecting rods (2) coupled to the fixing set (8) mounted on the crossbar (3) on one side of the basic shaft (4) to accomplish two strokes, two sets of auxiliary units (13) are installed symmetrically on the crossbar (3) on the other side of the basic shaft (4) to help accomplish another two strokes. Therefore, four strokes are completed.

Figure 9:
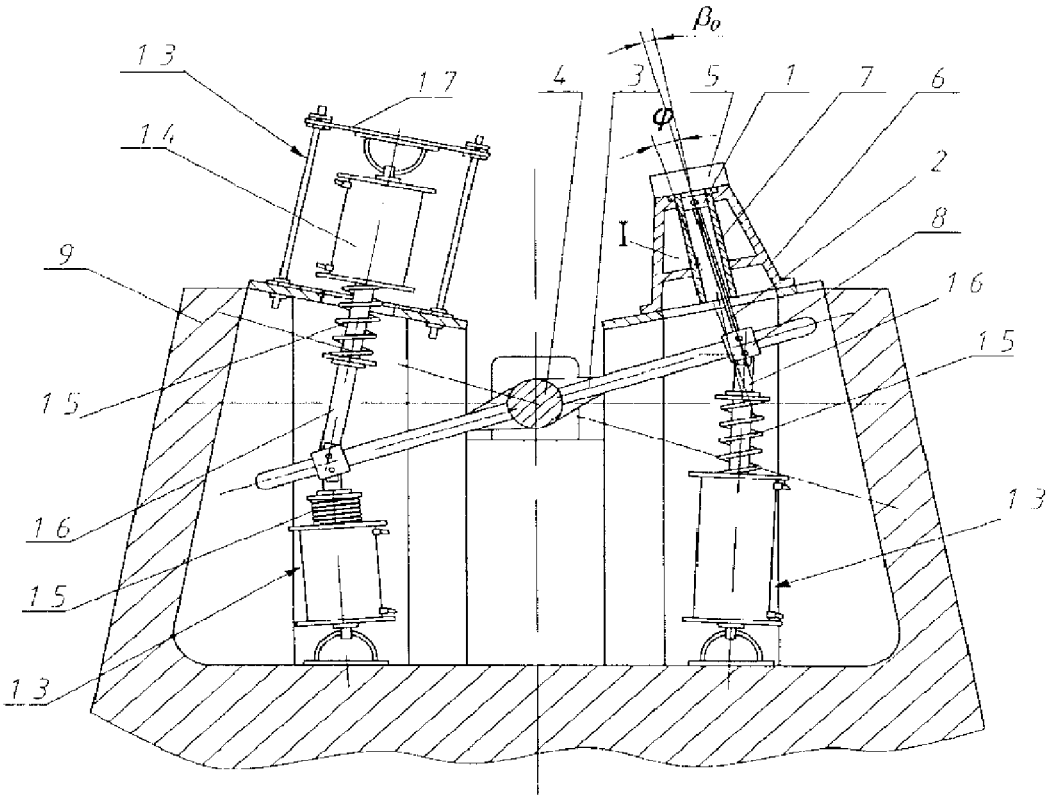
Figure 10:
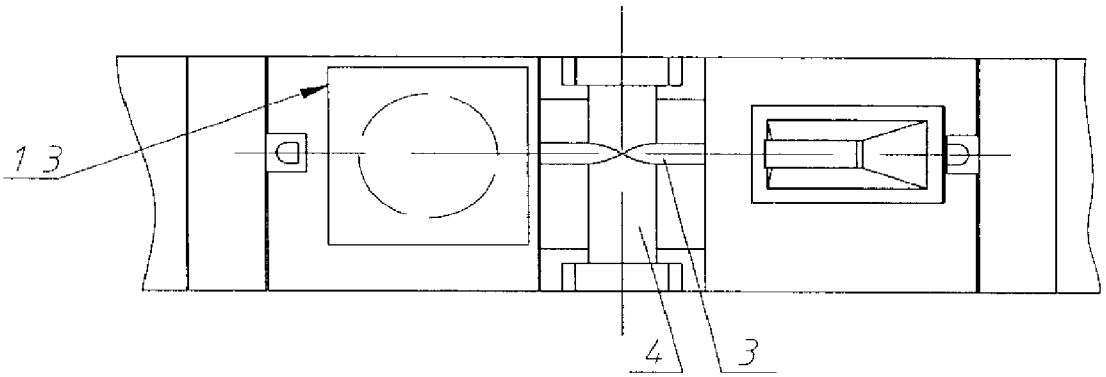
FIG. 10 is a plan view of FIG. 9.

As showed in FIG. 9, the fixing set (8) on the crossbar (3) which is on one side of the basic shaft (4) is equipped with a connecting rod (2). Only one stroke is completed, and an auxiliary unit (13) is provided between the cylinder (7) and the crossbar (3) which is equipped with a fixing set (8) to complete other three strokes together with two auxiliary units (13) arranged on the crossbar (3) on the other side of the basic shaft (4). Thus four strokes are completed.

As shown in FIG. 9, the auxiliary unit (13) can be chosen as connection of a hydrocylinder (14) to a spring (15) and a pull rod (16). One side of the crossbar (3) is flexibly connected with one end of a pull rod (16), the other end of which is connected to the hydrocylinder (14) inside the chassis (9) through a spring (15). In the same way, the other side of the crossbar (3) is flexibly connected with one end of a pull rod (16), the other end of which is connected through a spring (15) to the hydrocylinder (14) which is connected with a support (17) fixed on the chassis (9).

The auxiliary unit (13) can be chosen among the structures of hydrocylinder, hydrocylinder with lever, cylinder, and cylinder with spring or cylinder with lever.

Figure 11:
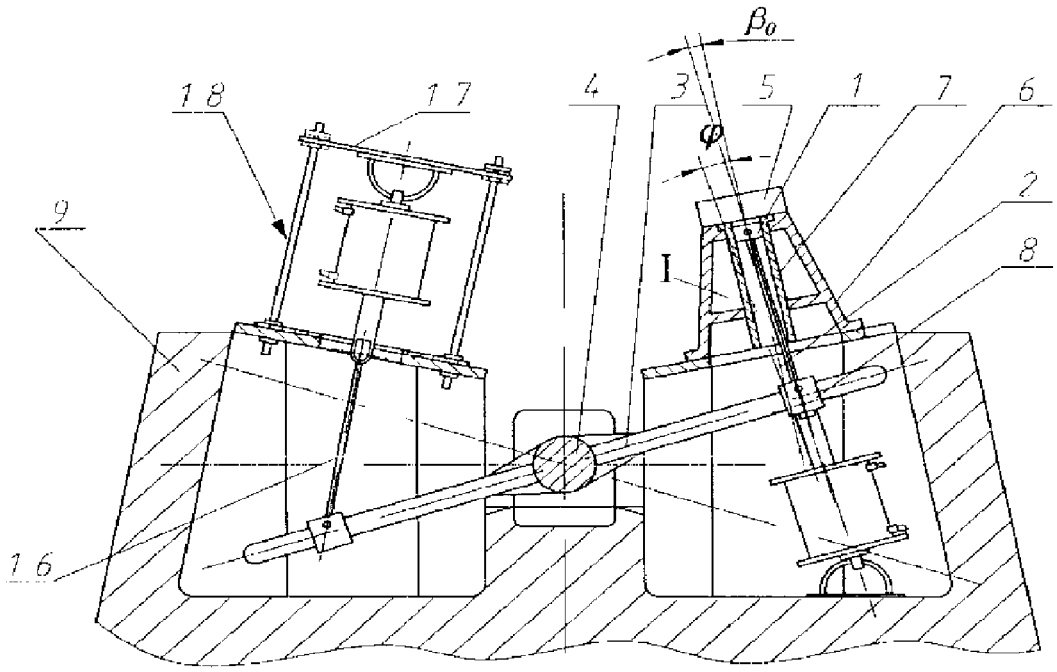
FIG. 11 is a schematic view showing a non-crankshaft engine that is installed with a power output unit.
Figure 12:
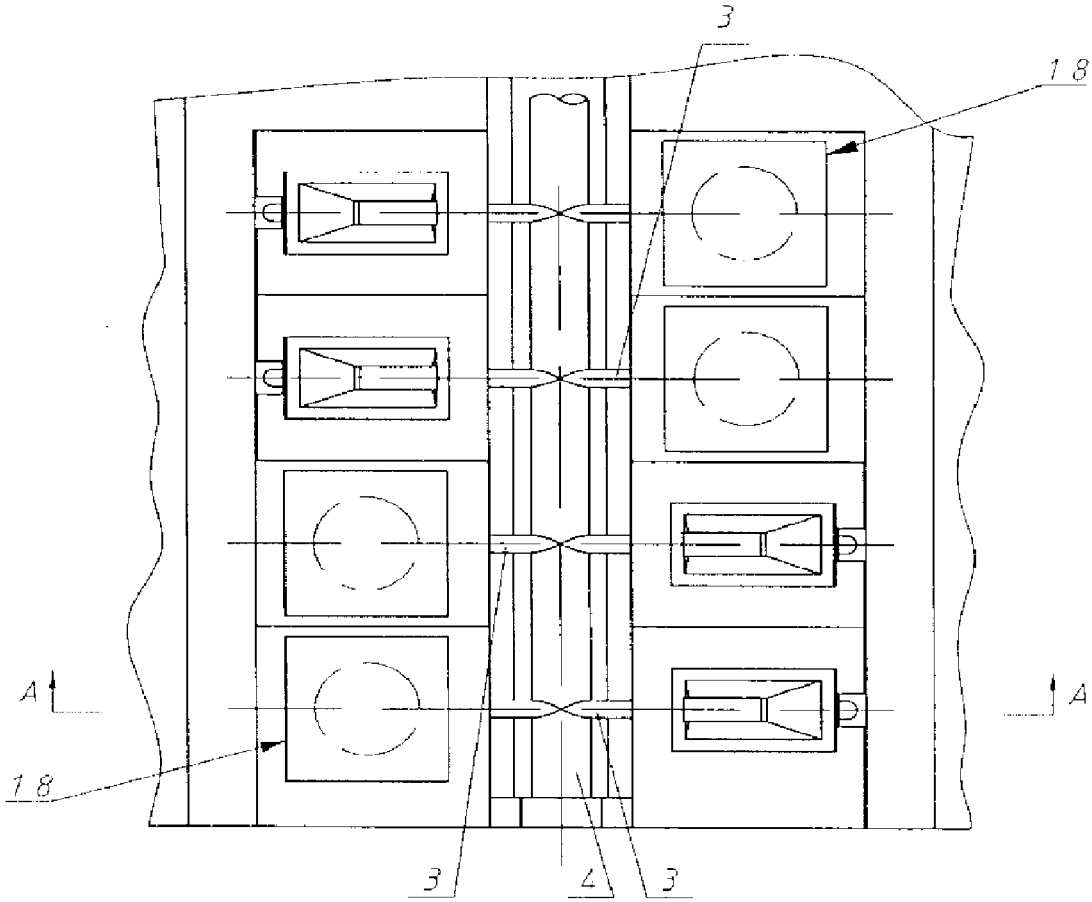
FIG. 12 is a plan view of FIG. 11.
Figure 13:
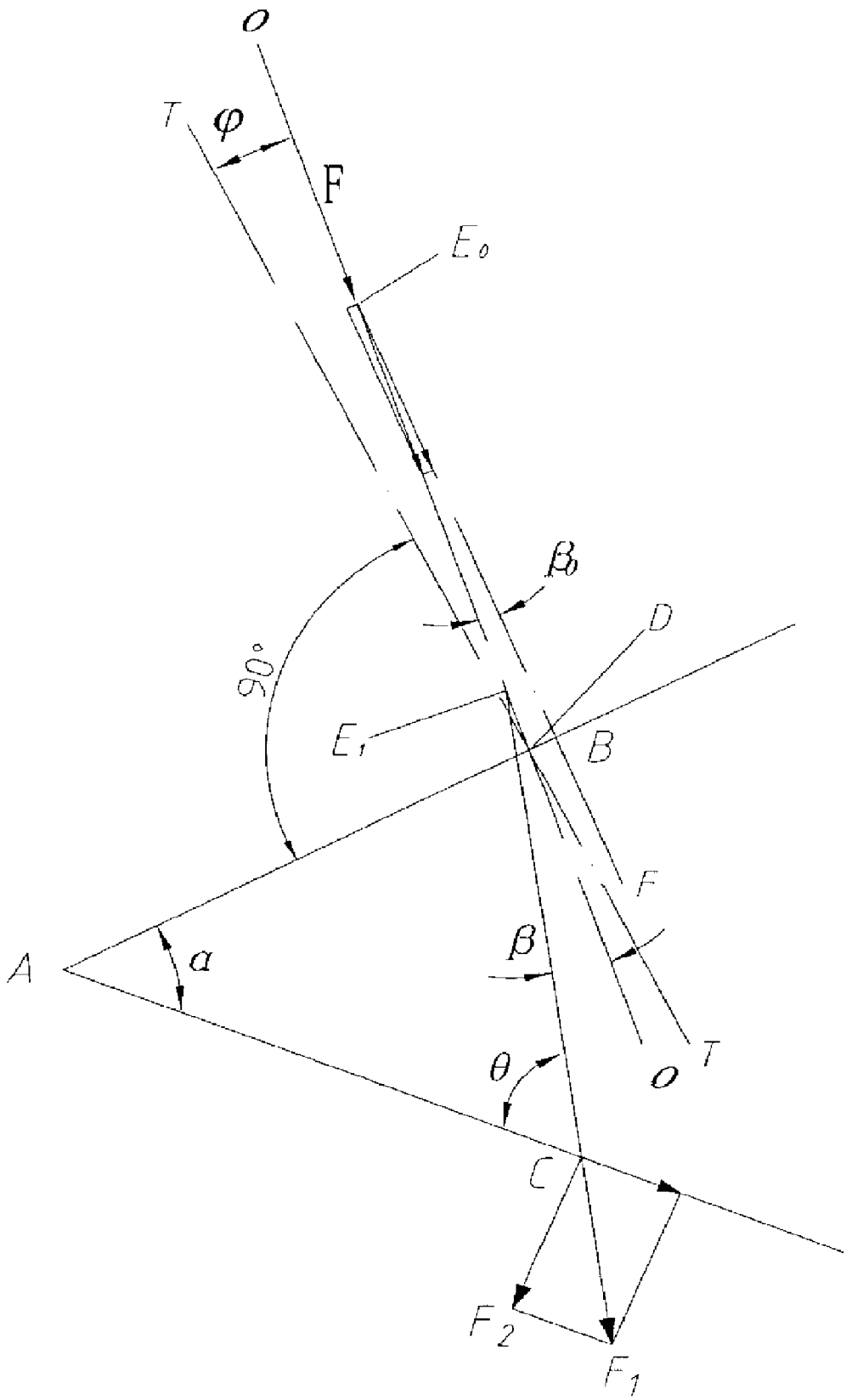
FIG. 13 demonstrates forces acting on the connecting rod, the crossbar, and the basic shaft in the non-crankshaft engine.
Figure 14:
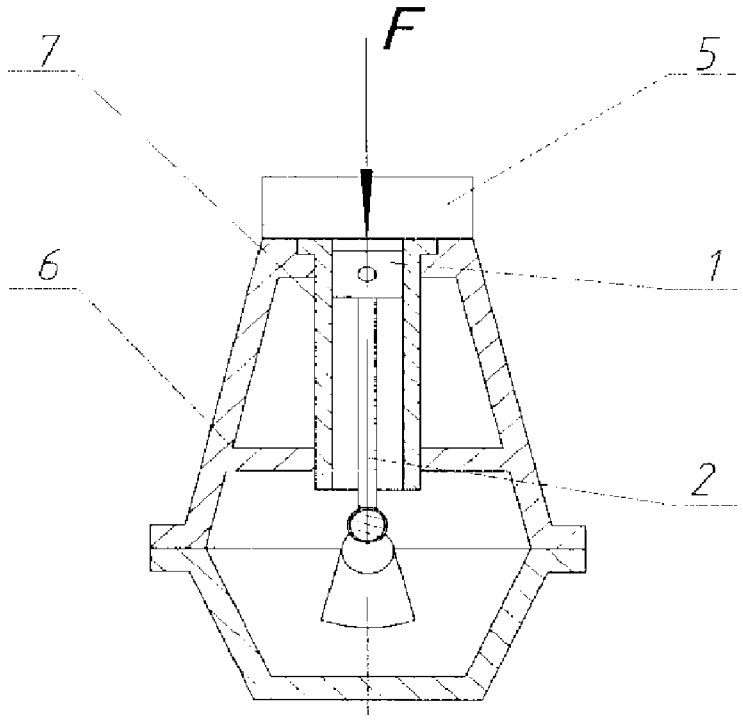
FIG. 14 is a view of the conventional diesel engine 6130 when a piston, a connecting rod, a crank, and a shaft journal are under stress at the beginning of an explosion stroke.
Figure 15:
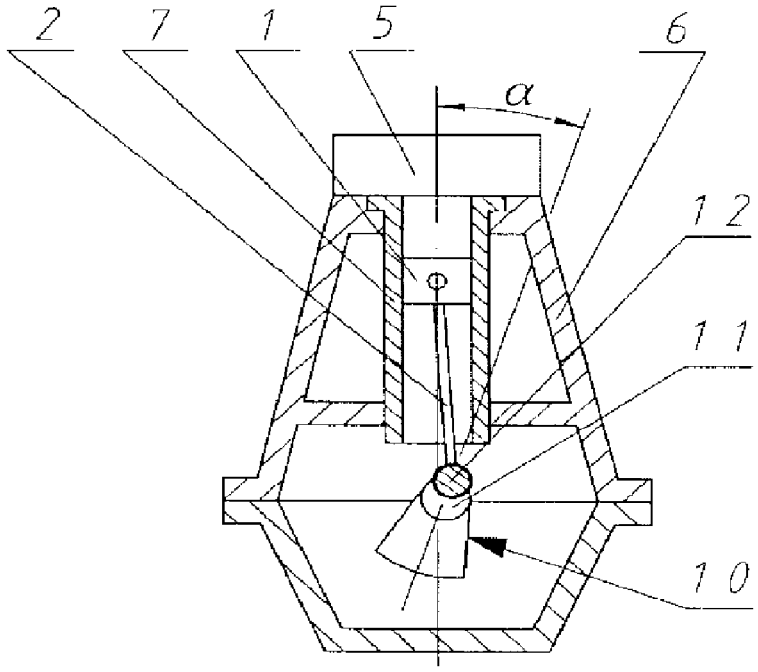
FIG. 15 is a schematic view showing the piston, the connecting rod, the crank and the shaft journal of the conventional diesel engine 6130 when the piston travels across an upper dead point and the crankshaft rotates by an angle $\alpha$.
Figure 16:
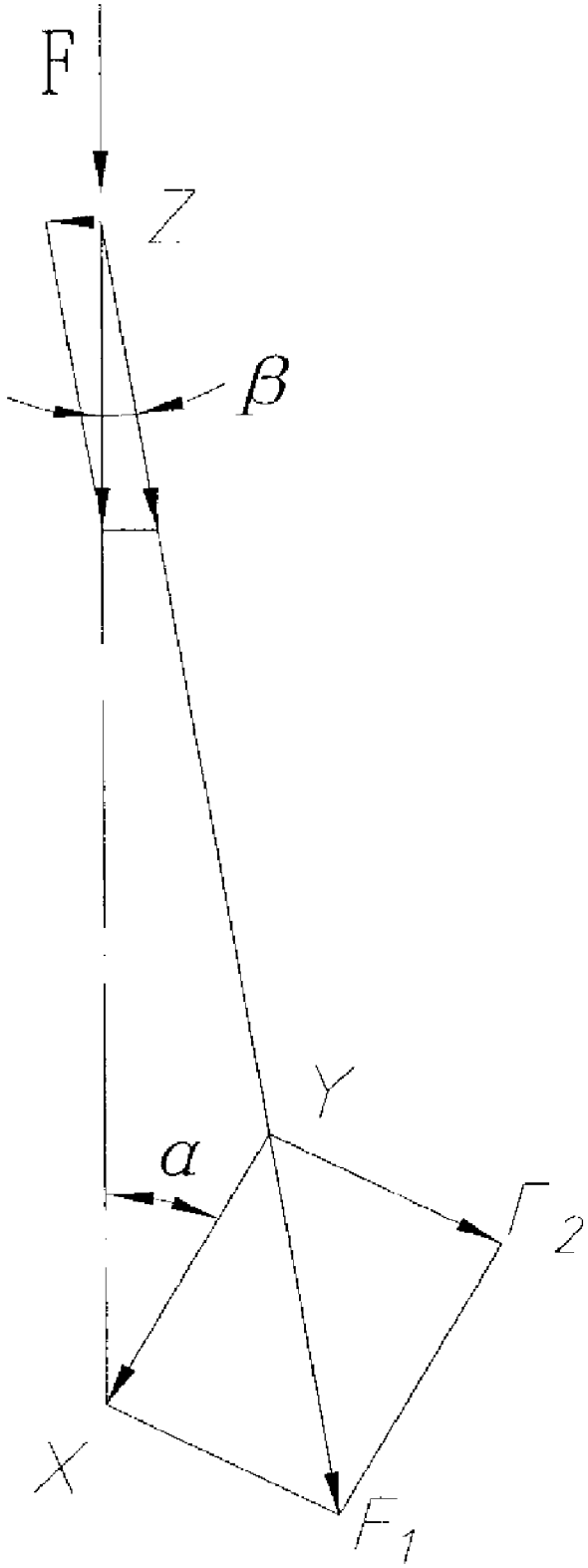
FIG. 16 demonstrates forces acting on the piston, the connecting rod, the crank, and the shaft journal of the conventional diesel engine 6130 i when the piston travels across an upper dead point and the crankshaft rotates by an angle $\alpha$.

As shown in FIGS. 11 and 12, a non-crankshaft engine according to the present invention comprises a plurality of bodies (6), a cylinder head (5) mounted on a top of each body, and a cylinder (7) formed inside each body. A piston (1) received in the cylinder (7) is connected with one end of a connecting rod (2); and each body (6) is fixed on a chassis (9), in the center of which is a basic shaft (4), perpendicularly connected with a number of crossbars (3), the number of which can be 2 or n×2. The crossbar (3) on one side of the basic shaft (4) is provided with a fixing set (8) or a power output unit (18), while the crossbar (3) on the other side is provided with the same installments but in reverse order. The fixing set (8) is flexibly connected with the other end of the connecting rod (2). Each fixing set (8) on the crossbar (3) is connected with one or two connecting rods (2), which are also connected to the piston (1). The connecting rods (2) are on the same side of the crossbar (3) when each fixing set (8) is connected with one connecting rod (2), and they are symmetrically distributed on opposite sides when there are two.

The power output unit (18) of the present invention can comprise hydrocylinders or hydrocylinders with spring. The power output unit (18) is connected to the crossbar (3) through a pull rod (16), where the latter two are in swing joint.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

The invention claimed is:

1. A non-crankshaft engine comprising a body (6), a cylinder head (5) mounted on a top of the body, and a cylinder (7) formed inside the body, a piston (1) received in the cylinder (7) and connected with one end of the connecting rod (2), the improvements comprising a basic shaft (4) arranged in middle of the chassis (9) where the body is set, and perpendicularly intersecting a crossbar (3) by means of a fixed joint or a swing joint, the crossbar (3) being installed, symmetrically on either side of the axis of the basic shaft (4), with a fixing set (8), which connects with the other end of the connecting rod (2) through a swing joint, wherein when the piston (1) is at one stop point of the cylinder head (5), a center line of the cylinder head (7) intersects a perpendicular of a center line of the crossbar (3) at an angle $\phi$, where $\phi$ is equal to or greater than 0° but smaller than 30° ($0° \leqq \phi < 30°$); a center line of the connecting rod (2) intersects the center line of the cylinder (7) at an angle $\beta_0$ where $\beta_0$ is equal to or greater than 0° but smaller than 15° ($0° \leqq \beta_0 < 15°$).

2. The non-crankshaft engine according to claim 1, wherein the basic shaft (4) connects with one or more crossbars (3).

3. The non-crankshaft engine according to claim 1, wherein each fixing set (8) on the crossbar (3) holds one or two connecting rods (2) which connect with the piston (1).

4. A non-crankshaft engine comprising a body (6), a cylinder head (5) mounted on a top of the body, and a cylinder (7) formed inside the body, a piston (1) received in the cylinder (7) and connected with one end of the connecting rod (2), the improvements comprising a basic shaft (4) arranged in the middle of a chassis (9) where the body is set and perpendicularly intersecting a crossbar (3) by means of a fixed joint or a swing joint, arranged on one side of the basic shaft being a crossbar (3) that is installed with a fixing set (8) or an auxiliary unit (13) that enables the connecting rod of the piston to run continuously and normally, and arranged on the other side of the basic shaft being a crossbar (3) with the same installments, but in reverse order, the fixing set (8) connecting with the other end of the connecting rod (2) through a swing joint, wherein when the piston (1) is at one stop point of the cylinder head (5), a center line of the cylinder head (7) intersects a perpendicular of a center line of the crossbar (3) at an angle $\phi$, where $\phi$ is equal to or greater than 0° but smaller than 30° ($0° \leqq \phi < 30°$); a center line of the connecting rod (2) intersects the center line of the cylinder (7) at an angle $\beta_0$, where $\beta_0$ is equal to or greater than 0° but smaller than 15° ($0° \leqq \beta_0 < 15°$).

5. The non-crankshaft engine according to claim 4, wherein the basic shaft (4) connects with one or more crossbars (3).

6. The non-crankshaft engine according to claim 4, wherein each fixing set (8) on the crossbar (3) has one or two connecting rods (2) which connect with the piston (1).

7. A non-crankshaft engine comprising a body (6), a cylinder head (5) mounted on a top of the body, and a cylinder (7) formed inside the body, a piston (1) received in the cylinder (7) and connected with one end of the connecting rod (2), the improvements comprising a basic shaft (4) arranged in the middle of a chassis (9) where the body is set and perpendicularly intersecting two or more crossbars (3) by means of a fixed joint or a swing joint, arranged on one side of the basic shaft (4) being a crossbar (3) that is installed with a fixing set (8) or a power output unit (18), and arranged on the other side of the basic shaft being a crossbar (3) with the same installments, but in reverse order, the fixing set (8) connecting with the other end of the connecting rod (2) through a swing joint.

8. The non-crankshaft engine according to claim 7, wherein when the piston (1) is at one stop point of the cylinder head (5), a center line of the cylinder head (7) intersects a perpendicular of a center line of the crossbar (3) at an angle $\phi$, where $\phi$ is equal to or greater than 0° but smaller than 30° ($0° \leqq \phi < 30°$); a center line of the connecting rod (2) intersects the center line of the cylinder (7) at an angle $\beta_0$, where $\beta_0$ is equal to or greater than 0° but smaller than 15° ($0° \leqq \beta_0 < 15°$).

* * * * *